United States Patent [19]

Bailey et al.

[11] Patent Number: 4,600,046

[45] Date of Patent: Jul. 15, 1986

[54] MOLDING APPARATUS AND PROCESS INCLUDING SAND COMPACTION SYSTEM

[75] Inventors: Frank V. Bailey, Racine; Robert T. Larsen, Three Lakes; Russell J. VanRens, West Allis, all of Wis.

[73] Assignee: Outboard Marine Corporation, Waukegan, Ill.

[21] Appl. No.: 671,629

[22] Filed: Nov. 15, 1984

Related U.S. Application Data

[63] Continuation-in-part of Ser. No. 568,051, Jan. 4, 1984, abandoned.

[51] Int. Cl.[4] ..... B22C 9/04; B22C 15/10

[52] U.S. Cl. ..... 164/34; 164/39; 164/203; 366/114

[58] Field of Search ..... 164/34, 35, 36, 39, 164/192, 194, 203, 206; 366/114

[56] References Cited

U.S. PATENT DOCUMENTS

| | | | |
|---|---|---|---|
| 1,127,471 | 2/1915 | MacDonald | 164/192 |
| 2,071,373 | 2/1937 | Wurzbach et al. | 366/114 X |
| 2,112,830 | 4/1938 | Corbin, Jr. . | |
| 2,756,973 | 7/1956 | Dostatni | 366/114 X |
| 3,425,670 | 2/1969 | Shaw . | |
| 3,620,508 | 11/1971 | Lea | 164/39 X |
| 3,724,819 | 4/1973 | Varnum et al. . | |
| 3,767,168 | 10/1973 | Dupré et al. . | |
| 3,812,625 | 5/1974 | Olson . | |
| 4,288,165 | 9/1981 | Fewel . | |

FOREIGN PATENT DOCUMENTS

| | | | |
|---|---|---|---|
| 53-92332 | 8/1978 | Japan | 164/39 |
| 406624 | 6/1974 | U.S.S.R. | 164/203 |

*Primary Examiner*—Nicholas P. Godici
*Assistant Examiner*—J. Reed Batten, Jr.
*Attorney, Agent, or Firm*—Michael, Best & Friedrich

[57] ABSTRACT

A molding apparatus comprising a rigid mold flask adapted to contain a mold pattern and sand, and when containing sand, having a combined center of gravity, a support for resiliently supporting the mold flask for horizontal movement only of the mold flask as a whole body, and a vibrator for shaking the mold flask to provide horizontal vibrational forces directed in a horizontal plane extending approximately through the combined center of gravity.

64 Claims, 8 Drawing Figures

MOLDING APPARATUS AND PROCESS INCLUDING SAND COMPACTION SYSTEM

RELATED APPLICATION

This is a continuation-in-part of U.S. patent application Ser. No. 568,051, filed on Jan. 4, 1984, and entitled "Molding Apparatus and Process Including Sand Compaction System and now abandoned."

Reference is made to copending U.S. patent application Ser. No. 567,330, filed on Dec. 30, 1983, and entitled "Lost Foam Casting Process and Apparatus."

BACKGROUND OF THE INVENTION

The invention relates to a molding or casting apparatus, and more particularly to a system in such an apparatus for compacting sand about a molding pattern in a mold flask.

In a lost foam casting process, the mold pattern which forms the desired molding cavity in the sand is a foam mold pattern that vaporizes when contacted by molten metal so that it need not be removed from the sand before casting. Since it is not necessary to remove the foam mold pattern from the sand before casting, the mold flask need not be separable into two parts, the cope and the drag, and the mold pattern can have a more complicated configuration than with conventional cope and drag flasks.

A lost foam casting process includes the steps of placing the foam mold pattern in the mold flask, compacting sand around the mold pattern, and pouring molten metal into the foam mold pattern. The molten metal causes the foam mold pattern to vaporize, and when the metal cools, the casting is removed from the sand.

Because the sand must be tightly compacted around the mold pattern in the flask, and because of the complicated mold pattern configurations permissible with a lost foam casting process, it is desirable to have a system which will facilitate sand migration and will compact the sand around the mold pattern to high sand pressure. Prior sand compaction systems do not provide the desired sand migration or sand pressure.

Prior systems vibrate the flask vertically from the top or bottom, or horizontally from the flask base with either multi- or unidirectional forces, or with a combination of these methods. Other prior systems provide a vibrator attached to a side panel of the flask to vibrate only the panel, causing localized response of the sand to the vibration.

Attention is directed to the following U.S. patents which disclose molding apparatus and vibrating apparatus:

Fewel U.S. Pat. No. 4,288,165, issued Sept. 8, 1981;
Olson U.S. Pat. No. 3,812,625, issued May 28, 1974;
Dupre et al. U.S. Pat. No. 3,767,168, issued Oct. 23, 1973;
Varnum et al. U.S. Pat. No. 3,724,819, issued Apr. 3, 1973;
Shaw U.S. Pat. No. 3,425,670, issued Feb. 4, 1969;
Corbin, Jr. U.S. Pat. No. 2,112,830, issued Apr. 15, 1938.

SUMMARY OF THE INVENTION

The invention provides a molding apparatus comprising a rigid mold flask adapted to contain a mold pattern and sand, and when containing the sand, having a combined center of gravity. The molding apparatus further comprises means for resiliently supporting the mold flask for horizontal movement only of the mold flask as a whole body, and means for shaking the mold flask to provide horizontal vibrational forces having a resultant force directed approximately through the combined center of gravity.

In one embodiment, the vibrational forces are also one dimensional, and the supporting means supports the mold flask for one dimensional horizontal movement only of the mold flask as a whole body.

In one embodiment, the flask supporting means comprises an air bag constrained to allow horizontal movement in the direction of the vibrational forces.

In one embodiment, the apparatus further comprises means for resiliently supporting the shaking means independently of the flask supporting means.

In one embodiment, the shaking means includes a pair of vibrators having counter-rotating members each rotating about a generally vertical axis, the vibrators being fixedly connected to each other and synchronized such that the resultant vibrational forces are horizontal and one dimensional.

In one embodiment, the vibrational forces are within the range of $\frac{1}{2}$ to 10 times the force of gravity and at frequencies between 8 and 100 Hz.

In one embodiment, the shaking means further includes a compaction table to which the vibrators are fixedly connected, and means connecting the compaction table to the flask for transmitting the vibrational forces to the flask.

The invention also provides a molding apparatus comprising a rigid mold flask adapted to contain a mold pattern and sand, and when containing sand, having a combined center of gravity, means for resiliently supporting the mold flask for horizontal movement only of the mold flask as a whole body, and means for shaking the mold flask to provide horizontal vibrational forces directed in a horizontal plane extending approximately through the combined center of gravity.

In one embodiment, the vibrational forces are also one dimensional, and the supporting means supports the mold flask for one dimensional horizontal movement only of the mold flask as a whole body.

The invention also provides a process for compacting sand around a mold pattern in a rigid mold flask for casting, the mold flask, when containing sand, having a combined center of gravity, the process comprising the steps of: resiliently supporting the rigid mold flask for horizontal movement only of the mold flask as a whole body, and shaking the mold flask to provide horizontal vibrational forces directed in a plane extending approximately through the combined center of gravity of the mold flask and the sand.

The invention also provides a process comprising the steps of resiliently supporting the rigid mold flask for horizontal movement only of the mold flask as a whole body, and shaking the mold flask to provide horizontal vibrational forces having a resultant force directed approximately through the combined center of gravity of the mold flask and the sand.

The invention also provides a molding apparatus comprising a rigid mold flask adapted to contain a mold pattern and sand, means fixedly assembled to the mold flask for shaking the assembly of the mold flask and the shaking means as a whole body, the shaking means, the sand, and the mold flask, when substantially filled with sand, having a combined center of gravity, the shaking means providing horizontal vibrational forces directed in a horizontal plane extending approximately through the combined center of gravity, and means for resiliently supporting the mold flask and the shaking means for horizontal movement only.

In one embodiment, the vibrational forces are one-dimensional and have a resultant force directed approximately through the combined center of gravity.

In one embodiment, the shaking means, the sand, and the mold flask, when partially filled with sand, have a second combined center of gravity lower than the first mentioned center of gravity, and the horizontal plane of the vibrational forces extends between the first and second combined centers of gravity.

In one embodiment, the shaking means includes means for selectively raising and lowering the horizontal plane of said vibrational forces.

In one embodiment, the shaking means includes a pair of vibrators having counter-rotating members each rotating about a generally vertical axis.

In one embodiment, the mold flask has a bottom end, and the supporting means includes a plurality of air bags beneath the mold flask, and a plurality of air bags beneath the shaking means.

In one embodiment, the molding apparatus further comprises interengageable means on the mold flask and on the shaking means for removably securing the shaking means to the mold flask.

In one embodiment, the said mold flask includes a vertical wall, and the interengageable means includes a connecting member fixedly attached to the vertical wall, and means connected to the shaking means for engaging the connecting member.

In one embodiment, the means for engaging the connecting member includes a generally horizontal arm including clamping means for engaging the connecting member.

In one embodiment, the connecting member has a portion including a generally vertical inner surface spaced apart from the vertical wall, and a generally vertical outer surface opposite the inner surface, and the clamping means includes a rigid member fixedly attached to the arm and adapted to engage the inner surface of the connecting member, and a movable member connected to the arm and adapted to engage the outer surface of the connecting member.

In one embodiment, the clamping means further includes a movable toggle linkage connected between the rigid member and the movable member of the clamping means such that movement of the toggle linkage causes movement of the movable member, and extendible and contractable hydraulic means connected between the arm and the toggle linkage for moving the toggle linkage so as to move the movable portion into and out of engagement with the outer surface of the connecting member.

In one embodiment, the molding apparatus further comprises means for conveying the mold flask to and from the shaking means.

In one embodiment, the conveying means conveys the mold flask generally horizontally to the shaking means such that the rigid member of the clamping means moves into a position between the vertical wall of the mold flask and the vertical inner surface of the connecting member, such that the rigid member of the clamping means is in position to engage the inner surface of the connecting member and the movable member of the clamping means is in position to engage the outer surface of the connecting member.

In one embodiment, the mold flask includes a vertical wall, and the interengageable means includes first and second horizontally spaced apart connecting members fixedly attached to the wall in a horizontal plane below the horizontal plane of the vibrational forces, a third connecting member fixedly attached to the wall in a horizontal plane above the horizontal plane of the vibrational forces, and means connected to the shaking means for engaging the first, second, and third connecting members.

The invention also provides a process for compacting sand around a mold pattern in a rigid mold flask, the process comprising the steps of: providing means fixedly assembled to the mold flask for shaking the assembly of the mold flask and the shaking means as a whole body, the shaking means, the sand, and the mold flask, when substantially filled with sand, having a combined center of gravity, resiliently supporting the mold flask and the shaking means for horizontal movement only, and shaking the assembly of the mold flask and the shaking means with the shaking means to provide horizontal vibrational forces directed in a horizontal plane extending approximately through the combined center of gravity.

A principal feature of the invention is that it provides vibrational forces directed in a horizontal plane extending approximately through the combined center of gravity, and which are preferably one dimensional as well. Because the flask is vibrated horizontally only, the molding process can be accomplished without removing the flask from a molding process conveyor. The shaking means can be located next to the mold flask as it sits on a conveyor belt, unlike with vertical shaking means that are typically located either above or below the flask, necessitating the removal of the flask from the conveyor belt. Since the flask can be left on the conveyor belt, time and energy are saved. Because the vibrational forces are directed approximately through the combined center of gravity, the mold flask tends not to rock as it is being shaken.

Another advantage of horizontal vibrational forces is that they minimize the amount of time required for sand compaction. Vertical vibrational forces tend to unsettle or "fluff up" the sand, thereby increasing the amount of time required for sand compaction.

Another feature of the invention is that the whole flask is displaced by the vibration, not just the flask walls. This improves the compaction of the sand.

Another feature of the invention is that it provides flask vibrational forces between 0.5 g's and 10 g's, and at frequencies between 8 Hz and 100 Hz. It has been found that such vibration in a molding apparatus having the aforementioned features compacts sand to higher sand pressure in about 25 percent of the time required by prior systems and with significantly less energy input than is required by prior systems.

Another principal feature of the invention is the provision of means for shaking the assembly of the mold flask and the shaking means with horizontal vibrational forces directed in a horizontal plane extending through the combined center of gravity of the shaking means, the mold flask, and the sand. Because the shaking means itself is part of the system being shaken, it is the location of the combined center of gravity of the shaking means, the mold flask, and the sand relative to the vibrational forces that determines whether and how much the mold flask will rock. Adding the fixed mass of the shaking means to the system greatly reduces the range of the vertical movement of the combined center of gravity of the system as the mold flask is shaken while being filled with sand. Because the combined center of gravity does not move as much, the vibrational forces are, on the average, closer to the vertically moving combined center of gravity. This reduces rocking of the mold flask.

Other features and advantages of the invention will become apparent to those skilled in the art upon review of the following detailed description, claims, and drawings.

Figure 1:
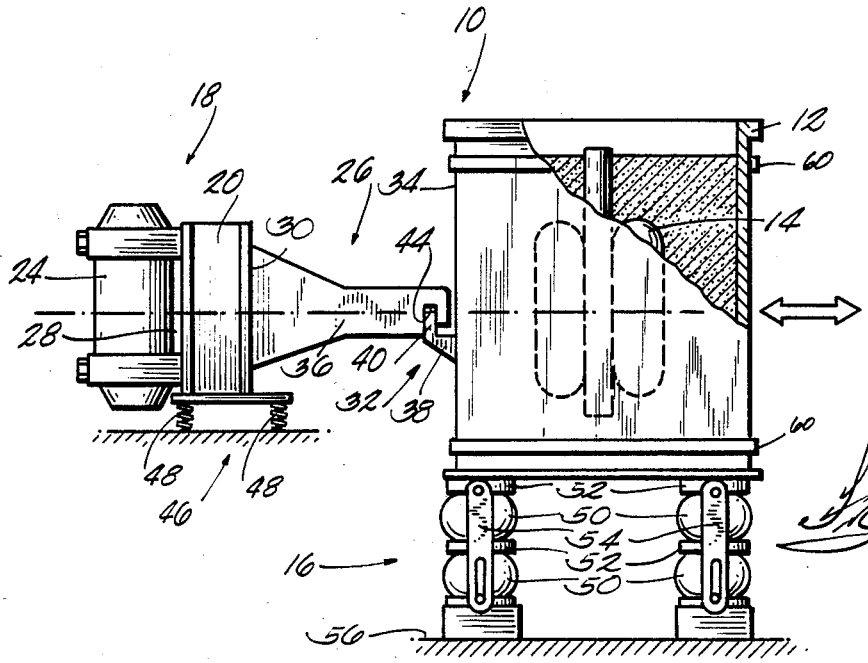
FIG. 1 is a side elevational view of a molding apparatus embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

While in the following description the invention is described as being used in a lost foam casting process, it should be understood that the invention can be used in other casting processes not employing foam mold patterns.

Illustrated in FIG. 1 is a molding apparatus 10 which embodies the invention and which includes a mold flask 12 adapted to contain a mold pattern 14 and sand. Although the mold flask 12 could have various constructions, in the drawings it is shown as having a generally square base and four vertical walls. Because the mold flask 12 is to be shaken as a whole body, as will be discussed below, the mold flask 12 includes a plurality of reinforcement members 60 (for convenience of illustration, only two are shown in the drawings) surrounding the mold flask 12 and helping to prevent movement of the mold flask base and walls relative to each other, so that the mold flask 12 moves as a whole body.

Also shown in FIG. 1 is a foam mold pattern 14 contained in the mold flask 12 and surrounded by sand. Wnen the mold flask 12 contains sand, the mold flask 12 and the sand have a combined center of gravity.

The molding apparatus 10 also includes means 16 for resiliently supporting the mold flask 12 for horizontal movement only of the mold flask 12 as a whole body, as shown in FIG. 1. These means 16 will be described in detail below.

The molding apparatus 10 further includes means 18 for shaking the mold flask 12 to provide horizontal vibrational forces directed in a horizontal plane extending approximately through the combined center of gravity. It should be understood that the mold flask 12 can be shaken either after the mold flask 12 has been filled with sand surrounding the mold pattern 14, or while the mold flask 12 is being filled with sand to surround the mold pattern 14.

In a process wherein the mold flask 12 is shaken while the mold flask 12 is being filled with sand, the combined center of gravity of the mold flask 12 and the sand will move, first down and then back up to the approximate mold flask center as sand is added. Therefore, the combined center of gravity will have high and low extreme locations. The means 18 for shaking the mold flask 12 provides horizontal vibrational forces in a horizontal plane located between the high and low extreme locations of the combined center of gravity.

Figure 2:
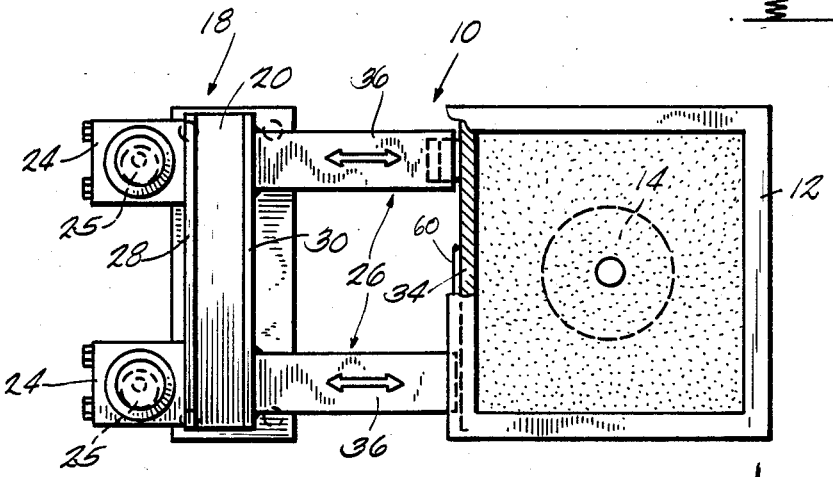
FIG. 2 is a top view of the molding apparatus of FIG. 1.

As best shown in FIG. 2, in the preferred embodiment, the vibrational forces provided by the shaking means 18 are also one dimensional and are directed approximately through the combined center of gravity, although this is not required by the invention. The vibrational forces of the preferred embodiment are also at levels between 0.5 g's and 10 g's and at frequencies between 8 Hz and 100 Hz.

Horizontal one dimensional vibrational forces within the above level and frequency ranges, directed approximately through the combined center of gravity, and shaking the mold flask 12 as a whole body rather than vibrating only a panel or wall of the mold flask 12, compact sand to higher sand pressure and require significantly less energy input than do prior systems.

Figure 3:
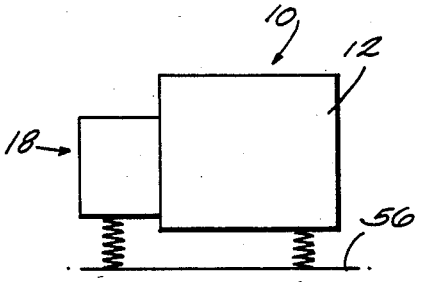
FIG. 3 is a schematic view of an alternative embodiment of the invention.

It should also be understood that the shaking means 18 need not be supported independently of the means 16 for resiliently supporting the mold flask 12, but could be attached to the mold flask 12 to form a single unit, as shown in FIG. 3. In this case the mold flask 12, the sand, and the shaking means 18 would have a combined center of gravity, and the vibrational forces would be directed approximately through this combined center of gravity.

While the means 18 for shaking the mold flask 12 could have various suitable constructions, in the preferred embodiment illustrated in FIGS. 1 and 2, the shaking means 18 comprises a compaction table 20, a pair of vibrators 24 fixedly attached to the compaction table 20, and means 26 connecting the compaction table 20 to the mold flask 12 for transmitting the vibrational forces to the flask 12. The compaction table 20 is a rectangular table having opposite planar surfaces 28 and 30, with the vibrators 24 being fixedly attached to one of the surfaces 28, and with the connecting means 26 connecting the other surface 30 to the mold flask 12. The vibrators 24 have counter-rotating members 25 (shown in dotted lines in FIG. 2) each rotating about a generally vertical axis, and the vibrators 24 are positioned and synchronized such that the resultant vibrational forces are horizontal and one dimensional.

While various suitable means 26 could be employed for connecting the compaction table 20 to the mold flask 12, in the illustrated construction, such means 26 comprises a pair of male connecting members 32 fixedly attached to a vertical wall 34 of the mold flask 12, and a pair of rigid connecting arms 36 fixedly attached to the compaction table 20 and engaging the male connecting members 32. The male connecting members 32 are positioned in the horizontal plane of the vibrational forces and comprise a horizontal portion 38 and a vertical portion 40. The horizontal portion 38 is fixedly attached to the flask wall 12 and extends outwardly therefrom, and the vertical portion 40 is integrally attached to the horizontal portion 38 and extends upwardly therefrom, the vertical portion 40 having an upper portion and being spaced apart from the wall 34 and generally parallel thereto. Each connecting arm 36 has first and second ends and a bottom surface and extends horizontally from the compaction table 20. Each second end is fixedly attached to the compaction table 20, and each first end has a vertical slot 44 extending horizontally through the connecting arm 36 and upwardly from the bottom surface of the connecting arm 36 through a portion of the connecting arm 36, the slot 44 having a lower portion slidably receiving the upper portion of the vertical portion 40 of one of the male connecting members 32.

The construction of the slot 44 in the connecting arms 36 and of the male connecting members 32 is such that only one dimensional horizontal forces are transmitted from the connecting arms 36 to the male connecting members 32. Because only the upper portion of the vertical portion 40 of the male connecting member 32 extends into only the lower portion of the slot 44, vertical forces are not transmitted from the connecting arm 36 to the male connecting member 32. Because the slot 44 extends horizontally completely through the connecting arm 36, no sideways forces are transmitted to the male connecting member 32. As a result, even if the pair of counter-rotating vibrators 24 produces some vertical or sideways vibration, the vertical or sideways vibration is not transmitted to the mold flask 12. The mold flask 12 vibrates only horizontally and in one dimension.

In the illustrated construction, the molding apparatus 10 further comprises means 46 for resiliently supporting the shaking means 18 independently of the flask supporting means 16. While various suitable means 46 for supporting the shaking means 18 could be employed, in the illustrated construction, these means 46 include a plurality of springs 48 extending upwardly from a supporting surface and supporting the compaction table 20. It should be understood that the shaking means 18 need not be supported above a supporting surface, but could be otherwise positioned relative to a supporting surface.

Returning now to the means 16 for resiliently supporting the mold flask 12 for horizontal movement only of the mold flask 12 as a whole body, it should be understood that various suitable means 16 could be employed for this purpose. In the construction illustrated in FIGS. 1 and 2, such means 16 comprises air bags 50 constrained to allow only horizontal one dimensional movement. Above each air bag 50 is a support plate 52. In the preferred embodiment, wherein the molding apparatus 10 is adapted to be shaken while it is being filled with sand, the air bags 50 are also preloaded so that the mold flask 12 will not move downwardly as it is filled with sand. The air bags 50 are constrained for substantially horizontal movement and are preloaded by constraining straps 54 which are pivotally connected between a supporting surface 56 and the uppermost support plates 52. The constraining straps 54 hold the air bags 50 down in a post-loading position (after the mold flask 12 is filled with sand) and they are pivotable so as to allow horizontal flask motion only in the direction of vibration.

Figure 4:
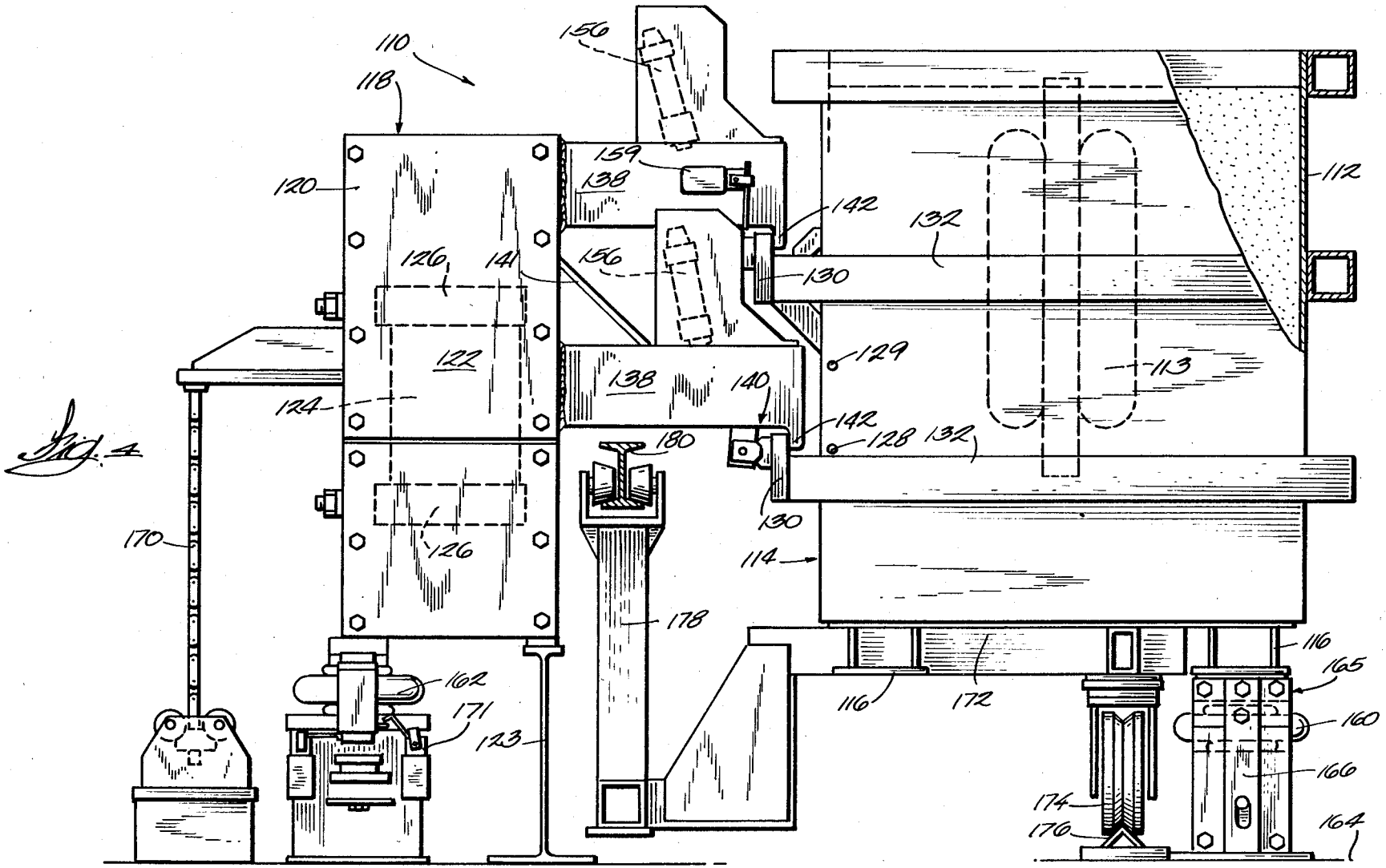
FIG. 4 is a side elevational view of a molding apparatus that is part of an alternative embodiment of the invention.

Illustrated in FIGS. 4 through 8 is an alternative embodiment of the invention. Illustrated in FIG. 4 is a molding apparatus 110 comprising a rigid mold flask 112 adapted to contain a mold pattern 113 and sand. The mold flask 112 is similar to the mold flask 12 illustrated in FIG. 1. The mold flask 112 has four vertical walls, including vertical wall 114, and a bottom wall. The mold flask 112 also includes support members 116 extending downwardly from the four corners of the bottom wall.

The apparatus 110 also comprises means 118 fixedly assembled to the mold flask 112 for shaking the assembly of the mold flask 112 and the shaking means 118 as a whole body. The shaking means 118, the sand, and the mold flask 112, when substantially filled with sand, have a combined center of gravity, and the shaking means 118 provides horizontal vibrational forces directed in a horizontal plane extending approximately through the combined center of gravity. In the preferred embodiment, the vibrational forces are one dimensional and have a resultant force directed through the combined center of gravity. In other words, the vibrational forces move back and forth along a horizontal line extending through the combined center of gravity.

While various suitable shaking means 118 can be employed, in the preferred embodiment, such means 118 includes a housing 120, and a pair of vibrators 122 mounted in the housing 120. When the shaking means 118 is not operating, the housing 120 rests on an air bag assembly, which will be described in detail hereinafter, and on a support member 123 which is fixed to a supporting surface 164. The vibrators 122 rotate about generally vertical axes and are synchronized such that the resultant vibrational force is directed approximately through the combined center of gravity. As best shown in FIG. 4, each vibrator 122 includes a motor 124 having a generally vertical drive shaft, and eccentric weights 126 mounted on the drive shaft above and below the motor 124. In the preferred embodiment, weights can be selectively added above and below the motor 124 in order to raise and lower the horizontal plane of the vibrational forces generated by the vibrator 122.

As explained previously herein, the mold flask 112 can be shaken while the mold flask 112 is being filled with sand. When this is done, the combined center of gravity of the mold flask 112, the shaking means 118, and the sand will move, first downwardly (when the mold flask 112 is only partially filled with sand) to a lowest combined center of gravity 128, and then upwardly (as the mold flask 112 is further filled with sand) to a highest combined center of gravity 129 when the mold flask 112 is substantially filled with sand. In this case, the vibrational forces extend approximately through a vertical line between the first or highest combined center of gravity 129 (when the mold flask 112 is substantially filled with sand) and the second or lowest combined center of gravity 128 (when the mold flask 112 is partially filled with sand).

It should be noted that, in the preferred embodiment, the weight of the mold pattern 113 is not supported by the apparatus 110. The mold pattern 113 is preferably supported by supporting means located above the mold flask 112. For an example of such supporting means, see copending U.S. Bailey, et al. patent application Ser. No. 567,330, filed Dec. 30, 1983, and titled "Lost Foam Casting Process and Apparatus." Because the mold pattern 113 is not supported by the mold flask 112, the weight of the mold pattern 113 does not affect the location of the combined center of gravity. While the volume and shape of the mold pattern 113 will affect the location of the combined center of gravity, because the volume and location of sand in the mold flask 112 depend on the volume and shape of the mold pattern 113, this effect is negligible.

The shaking means 118 and the mold flask 112 also include interengageable means for removably assembling or securing the shaking means 118 to the mold flask 112. While various suitable means can be employed for this purpose, in the preferred embodiment, such means includes connecting members 130 fixedly attached to the vertical wall 114 of the mold flask 112, and means on the shaking means 118 for engaging the connecting members 130.

In the illustrated construction, the mold flask 112 includes reinforcement members 132 similar to the reinforcement members 60 shown in FIG. 1. The connecting members 130 are rectangular blocks having a lower portion fixedly attached to a reinforcement member 132 along the vertical wall 114, and an upper portion extending upwardly from the reinforcement member 132 and spaced from the vertical wall 114. The portion of the connecting member 130 extending upwardly from the reinforcement member 132 includes a generally vertical inner surface 134 (see FIG. 7) spaced apart from the vertical wall 114, and a generally vertical outer surface 136 (see FIG. 8) opposite the inner surface 134. The connecting members 130 are arranged in a triangular pattern, with two connecting members 130 being attached to the lower reinforcement member 132 and one connecting member 130 being attached to the upper reinforcement member 132. In the preferred embodiment, the upper connecting member 130 is above the highest combined center of gravity and the lower connecting members 130 are below the lowest combined center of gravity. Therefore, the upper connecting member 130 is in a horizontal plane above the horizontal plane of the vibrational forces, and the lower connecting members 130 are in a horizontal plane below the horizontal plane of the vibrational forces. This minimizes rocking of the mold flask 112 relative to the shaking means 118.

Figure 6:
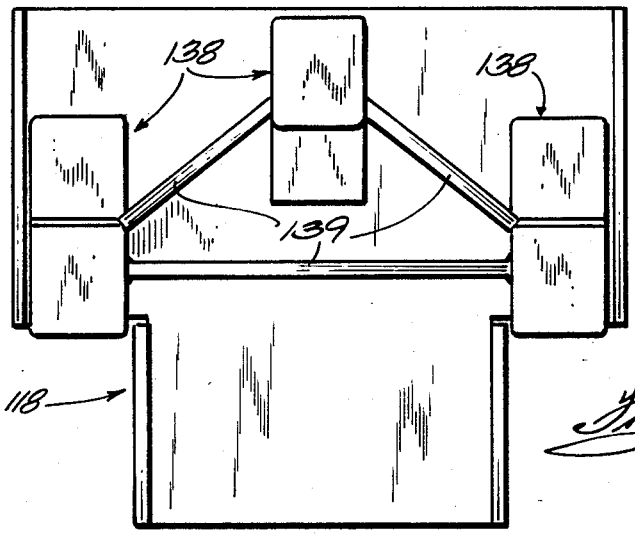
FIG. 6 is a cross sectional view taken along line 6—6 in FIG. 4.

In the illustrated construction, the means for engaging the connecting members 130 includes three generally horizontal arms 138 each having one end connected to the housing 120 and an opposite end including clamping means 140 for engaging a connecting member 130. As best shown in FIG. 6, support struts 139 between the arms 138 help maintain the rigidity of the arms 138. Support struts 141 (see FIG. 4) between the arms 138 and the housing 120 help maintain the arms 138 in a horizontal position.

Figure 7:
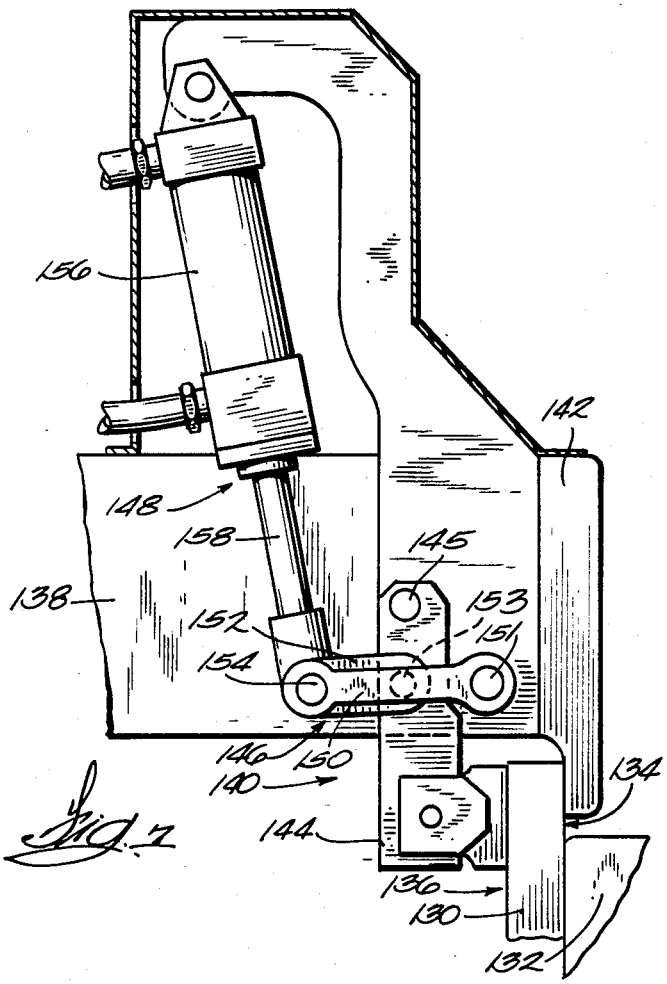
FIG. 7 is a cross sectional view of the clamping means engaging a connecting member on the mold flask.
Figure 8:
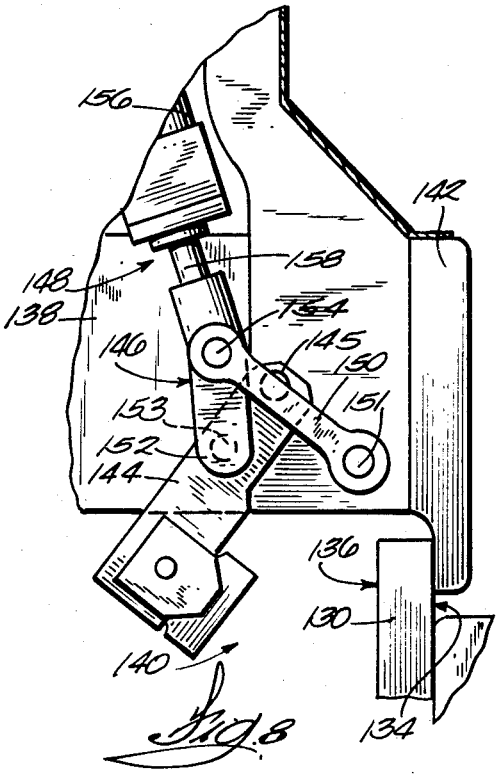
FIG. 8 shows the clamping means out of engagement with the connecting member.

As best shown in FIGS. 7 and 8, the clamping means 140 includes a rigid member 142 fixedly attached to the arm 138 and adapted to engage the inner surface 134 of the connecting member 130, and a movable member 144 connected to the arm 138 and adapted to engage the outer surface 136 of the connecting member 130. In the illustrated construction, the movable member 144 rotates relative to the arm 138 about a generally horizontal axis 145. The movable member 144 includes a pad 147 which engages the outer surface 136 of the connecting member 130 and which is pivotable relative to the remainder of the movable member 144. The clamping means 140 further includes a movable toggle linkage 146 connected between the arm 138 and the movable member 144 such that movement of the toggle linkage 146 causes movement of the movable member 144, and extendible and contractable hydraulic means 148 connected between the arm 138 and the toggle linkage 146 for moving the toggle linkage 146 so as to move the movable member 144 into and out of engagement with the outer surface 136 of the connecting member 130.

In the preferred embodiment, the toggle linkage 146 includes a first elongated member 150 having a longitudinal axis and one end pivotally connected to the arm 138 for pivotal movement about a horizontal axis 151, and a second shorter elongated member 152 having one end pivotally connected to the movable member 144 for movement with the movable member 144 and for pivotal movement relative to the movable member 144 about a horizontal axis 153. The opposite ends of the first and second elongated members 150 and 152, respectively, are pivotally connected to each other at a movable pivot point 154. The arm 138 includes an adapter portion 155 extending upwardly from the end of the arm 138, and the hydraulic means 148 includes a hydraulic cylinder 156 pivotally connected to the adapter portion 155, a piston (not shown) slidably received in the cylinder 156, and a piston rod 158 having one end connected to the piston and an opposite end pivotally connected to the opposite ends of the first and second elongated members 150 and 152 at the pivot point 154. Such a hydraulic piston and cylinder is conventional and need not be explained in greater detail. Any suitable means can be used for operating the piston and cylinder.

When the piston rod 158 is retracted, as shown in FIG. 8, the pivot point 154 and the opposite ends of the first and second elongated members 150 and 152 are moved upwardly, and the movable member 144 is moved upwardly out of engagement with the connecting member 130. When the piston rod 158 is extended, as shown in FIG. 7, the pivot point 154 and the opposite ends of the first and second elongated members 150 and 152 are moved downwardly into an overcenter position, and the movable member 144 is moved into engagement with the connecting member 130. The elongated members 150 and 152 are in an overcenter position because the longitudinal axis of the first elongated member 150 passes over the pivot point 153 of the second elongated member 152 relative to the arm 138. While the second elongated member 152 is essentially rigid, the first elongated member 150 actually stretches somewhat. Because of the overcenter arrangement, the toggle linkage 146 becomes locked into place, since it is necessary to stretch the first elongated member 150 in order to move the toggle linkage 146 out of the overcenter position.

Figure 5:
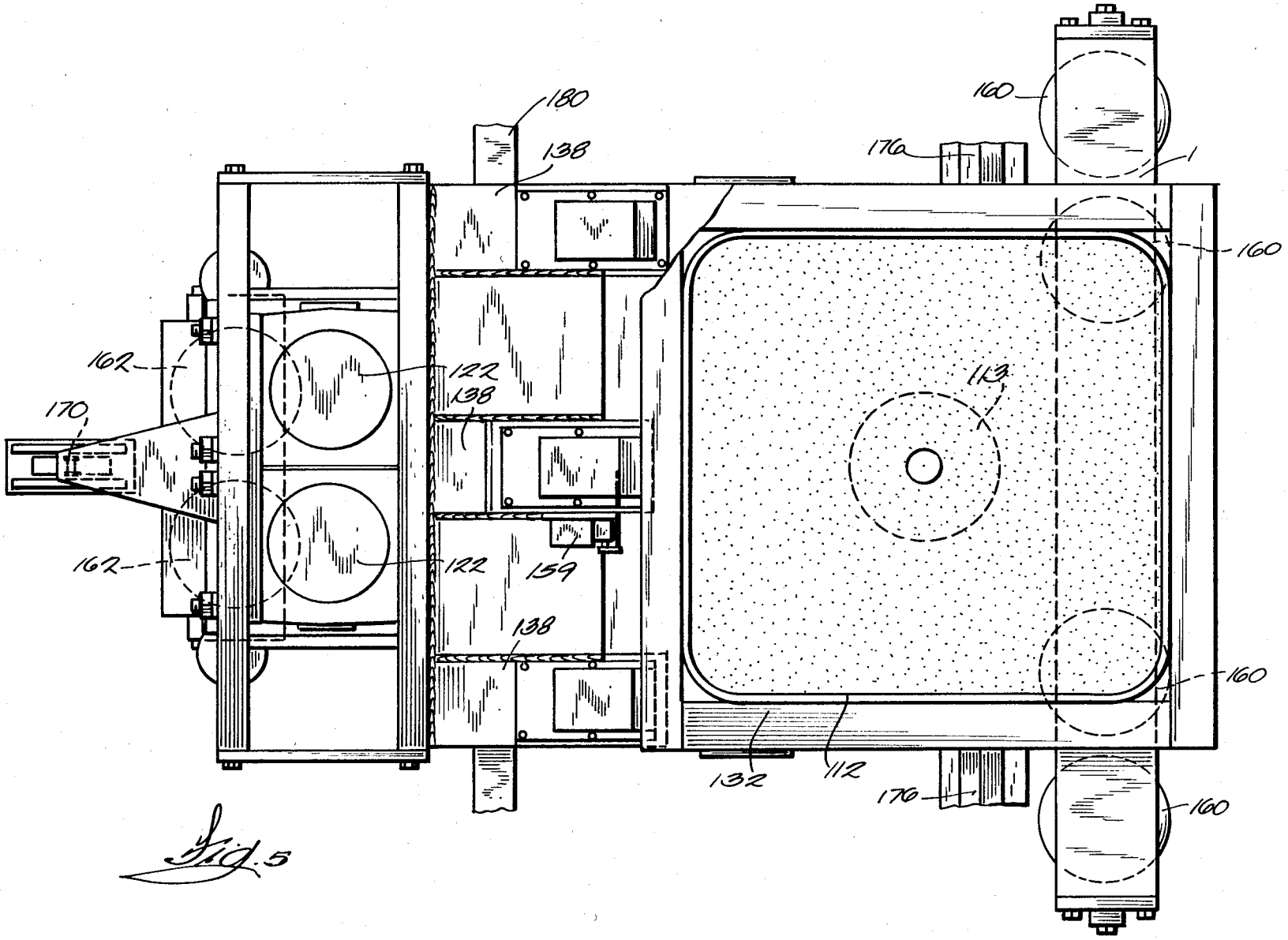
FIG. 5 is a top view of the molding apparatus of FIG. 4.

As best shown in FIGS. 4 and 5, the apparatus 110 includes a limit switch 159 mounted on the upper arm 138 and having an arm engageable with the movable member 144. The limit switch 159 indicates when the movable member 144 is in engagement with the connecting member 130, or when the shaking means 118 is clamped to the mold flask 112. In alternative embodiments (not shown), the apparatus 110 can include similar limit switches on the two lower arms 138, and can also include limit switches on the arms 138 for indicating when the shaking means 118 is not clamped to the mold flask 112.

The apparatus 110 further comprises means for resiliently supporting the mold flask 112 and the shaking means 118 for horizontal movement only. While various suitable means can be employed for this purpose, in the illustrated construction, such means includes a plurality of air bags 160 beneath the mold flask 112, and a plurality of air bags 162 beneath the shaking means 118. More particularly, the supporting means for the mold flask 112 includes an assembly having four air bags 160 positioned between the supporting surface 164 and a supporting member 165. When the air bags 160 are inflated, the supporting member 165 is lifted until it engages the two support members 116 on the mold flask 112 farthest from the shaking means 118, after which further lifting of the supporting member 165 lifts the mold flask 112. Lifting of the supporting member 165 and consequently of the mold flask 112 is limited by constraining straps 166 similar to the constraining straps 54 shown in FIG. 1.

The means for supporting the shaking means 118 includes a plurality of air bag assemblies positioned between the shaking means 118 and the supporting surface 164. When the air bags 162 are inflated, the shaking means 118 is lifted. Lifting of the shaking means 118 is limited by a chain 170 having a lower end connected to the supporting surface 164 and an upper end connected to the rear wall of the housing 120.

As best shown in FIG. 4, the apparatus 110 includes a limit switch 171 mounted on one of the air bag assemblies for indicating when the shaking means 118 is not lifted. In alternative embodiments (not shown), the apparatus 110 can also include similar limit switches for indicating when the mold flask 112 is not lifted, and limit switches for indicating when the shaking means 118 and/or mold flask 112 is lifted.

The apparatus 110 further comprises means for conveying the mold flask 112 to and from the shaking means 118. In the preferred embodiment, as best shown in FIG. 4, the conveying means includes a conveyor member 172 adapted to support the mold flask 112. The conveyor member 172 extends partially beneath the mold flask 112, just short of the support members 116 farthest from the shaking means 118. This allows room for the supporting member 165 of the air bag assembly beneath these support members 116. The end of the conveyor member 172 beneath the mold flask 112 is supported by wheels 174 which run on a track 176 on the supporting surface 164 and extending perpendicularly to the arms 138 of the shaking means 118. The opposite end of the conveyor member 172 is supported by a wheel assembly 178 running on an overhead track 180 beneath the arms 138 of the shaking means 118 and extending perpendicularly to the arms 138 and parallel to the track 176. Thus, the mold flask 112 is conveyed to and from the shaking means 118 in a direction perpendicular to the arms 138.

The conveying means is positioned such that, when the mold flask 112 is conveyed to the shaking means 118, the rigid members 142 of the clamping means 140 move into a positon between the wall 114 of the mold flask 112 and the inner surface 134 of the connecting members 130, such that the rigid members 142 are in position to engage the inner surfaces 134 of the connecting members 130 and the movable members 144 are in position to engage the outer surfaces 136 of the connecting members 130. After the clamping means 140 engage their respective connecting members 130, so that the shaking means 118 is secured to the mold flask 112, the air bag assemblies are inflated so that the mold flask 112 is lifted off the conveyor member 172 and the shaking means housing 120 is lifted from the supporting surface 164. The shaking means 118 and mold flask 112 are then supported for horizontal vibration.

Various of the features of the invention are set forth in the following claims.

We claim:

1. A process for compacting sand around a mold pattern in a rigid mold flask for casting, the mold flask, when containing sand, having a combined center of gravity, said process comprising the steps of: resiliently supporting the rigid mold flask for horizontal movement only of the mold flask as a whole body, and shaking the mold flask to provide horizontal vibrational forces directed in a horizontal plane extending approximately through the combined center of gravity of the mold flask and the sand.

2. A process in accordance with claim 1 and further comprising the steps of: supporting the mold flask for one dimensional horizontal movement only of the mold flask as a whole body, and shaking the mold flask to provide one dimensional horizontal vibrational forces directed approximately through the combined center of gravity.

3. A process in accordance with claim 1 and further comprising the step of shaking the mold flask to provide vibrational forces within the range of $\frac{1}{2}$ to 10 g's and at frequencies between 8 and 100 Hz.

4. A process for compacting sand around a mold pattern in a rigid mold flask for casting, the mold flask, when containing sand, having a combined center of gravity, said process comprising the steps of: resiliently supporting the rigid mold flask for horizontal movement only of the mold flask as a whole body, and shaking the mold flask to provide horizontal vibrational forces having a resultant force directed approximately through the combined center of gravity of the mold flask and the sand.

5. A process in accordance with claim 4 and further comprising the steps of: supporting the mold flask for one dimensional horizontal movement only of the mold flask as a whole body, and shaking the mold flask to provide one dimensional horizontal vibrational forces directed approximately through the combined center of gravity.

6. A process in accordance with claim 5 and further comprising the step of shaking the mold flask to provide vibrational forces within the range of $\frac{1}{2}$ to 10 g's and at frequencies between 8 and 100 Hz.

7. A process for compacting sand around a mold pattern in a rigid mold flask, said process comprising the steps of: providing means fixedly assembled to the mold flask for shaking the assembly of the mold flask and the shaking means as a whole body, the shaking means, the sand, and the mold flask, when substantially filled with sand, having a combined center of gravity, resiliently supporting the mold flask and the shaking means for horizontal movement only, and shaking the assembly of the mold flask and the shaking means with the shaking means to provide horizontal vibrational forces directed in a horizontal plane extending approximately through the combined center of gravity.

8. A process as set forth in claim 7 wherein said shaking step further includes the step of shaking the assembly of the mold flask and the shaking means to provide one dimensional horizontal vibrational forces having a resultant force directed approximately through the combined center of gravity.

9. A molding apparatus comprising a rigid mold flask having a bottom and adapted to contain a mold pattern and sand, means for resiliently supporting said mold flask for horizontal movement only of said mold flask as a whole body, and means for shaking said mold flask to provide horizontal vibrational forces having a resultant force directed in a horizontal plane spaced above said flask bottom.

10. A molding apparatus comprising a rigid mold flask adapted to contain a mold pattern and sand, and when containing sand, having a combined center of gravity, means for resiliently supporting said mold flask for horizontal movement only of said mold flask as a whole body, and means for shaking said mold flask to provide horizontal vibrational forces having a resultant force directed approximately through the combined center of gravity.

11. A molding apparatus in accordance with claim 10 wherein said vibrational forces are also one dimensional, and wherein said supporting means supports said mold flask for one dimensional horizontal movement only of said mold flask as a whole body.

12. A molding apparatus in accordance with claim 10 wherein said flask supporting means comprises an air bag constrained to allow horizontal movement in the direction of said vibrational forces.

13. A molding apparatus in accordance with claim 10 wherein said shaking means is attached to said flask, wherein said means for resiliently supporting supports said mold flask and said shaking means for horizontal movement only of said mold flask and said shaking means as a whole body, and wherein said shaking means provides horizontal vibrational forces having a resultant force directed through the combined center of gravity of said mold flask, the sand, and said shaking means.

14. A molding apparatus in accordance with claim 10 wherein said shaking means includes a pair of vibrators having counter-rotating members each rotating about a generally vertical axis, said vibrators being connected to each other and synchronized such that the resultant vibrational forces are horizontal and one dimensional.

15. A molding apparatus in accordance with claim 10 wherein said vibrational forces are within the range of ½ to 10 times the force of gravity and at frequencies between 8 and 100 Hz.

16. A molding apparatus in accordance with claim 10 and further comprising means for resiliently supporting said shaking means independently of said flask supporting means.

17. A molding apparatus in accordance with claim 16 wherein said means for supporting said shaking means includes a spring having one end connected to a supporting surface and having another end connected to and supporting said shaking means.

18. A molding apparatus in accordance with claim 16 wherein said shaking means includes a pair of vibrators having counter-rotating members each rotating about a generally vertical axis, said vibrators being connected to each other and synchronized such that the resultant vibrational forces are horizontal and one dimensional.

19. A molding apparatus comprising a rigid mold flask adapted to contain a mold pattern and sand, and when containing sand, having a combined center of gravity, means for resiliently supporting said mold flask for horizontal movement only of said mold flask as a whole body, and means for shaking said mold flask to provide horizontal vibrational forces directed in a horizontal plane extending approximately through the combined center of gravity.

20. A molding apparatus in accordance with claim 19 wherein said vibrational forces are also one dimensional, and wherein said supporting means supports said mold flask for one dimensional horizontal movement only of said mold flask as a whole body.

21. A molding apparatus in accordance with claim 19 wherein said flask supporting means comprises an air bag constrained to allow horizontal movement in the direction of said vibrational forces.

22. A molding apparatus in accordance with claim 19 wherein said shaking means is attached to said flask, wherein said means for resiliently supporting supports said mold flask and said shaking means for horizontal movement only of said mold flask and said shaking means as a whole body, and wherein said shaking means provides horizontal vibrational forces having a resultant force directed through the combined center of gravity of said mold flask, the sand, and said shaking means.

23. A molding apparatus in accordance with claim 19 wherein said shaking means includes a pair of vibrators having counter-rotating members each rotating about a generally vertical axis, said vibrators being connected to each other and synchronized such that the resultant vibrational forces are horizontal and one dimensional.

24. A molding apparatus in accordance with claim 19 wherein said vibrational forces are within the range of ½ to 10 times the force of gravity and at frequencies between 8 and 100 Hz.

25. A molding apparatus in accordance with claim 19 and further comprising means for resiliently supporting said shaking means independently of said flask supporting means.

26. A molding apparatus in accordance with claim 25 wherein said means for supporting said shaking means includes a spring having one end connected to a supporting surface and having another end connected to and supporting said shaking means.

27. A molding apparatus in accordance with claim 25 wherein said shaking means includes a pair of vibrators having counter-rotating members each rotating about a generally vertical axis, said vibrators being connected to each other and synchronized such that the resultant vibrational forces are horizontal and one dimensional.

28. A molding apparatus comprising a rigid mold flask adapted to contain a mold pattern and sand, and when containing sand, having a combined center of gravity, means for shaking said mold flask to provide one dimensional horizontal vibrational forces, with said vibrational forces being directed approximately through the combined center of gravity, said shaking means including a pair of vibrators having counter-rotating members each rotating about a generally vertical axis, said vibrators being connected to each other and synchronized such that the resultant vibrational forces are horizontal and one dimensional, and means for resiliently supporting said mold flask for one dimensional horizontal movement only of said mold flask as a whole body, said means comprising an air bag constrained to allow only substantially one dimensional horizontal movement, said movement being in the direction of said vibrational forces.

29. A molding apparatus in accordance with claim 28 wherein said vibrational forces are within the range of 178 to 10 times the force of gravity and at frequencies between 8 and 10 Hz.

30. A molding apparatus in accordance with claim 28 wherein said shaking means further includes a compaction table to which said vibrators are fixedly connected, and means connecting said compaction table to said flask for transmitting said vibrational forces to said flask.

31. A molding apparatus in accordance with claim 30 wherein said flask includes a vertical wall, and wherein said means connecting said compaction table to said flask includes a male connecting member fixedly attached to said vertical wall of said flask, said male connecting member being positioned approximately in a horizontal plane passing through the combined center of gravity and comprising a horizontal portion fixedly attached to said wall and extending outwardly therefrom, and a vertical portion connected to said horizontal portion and extending upwardly therefrom, said vertical portion having an upper portion and being spaced apart from said wall, and a horizontally disposed rigid connecting arm extending from said compaction table and having first and second ends and a bottom surface, said second end of said connecting arm being fixedly attached to said compaction table, and said first end of said connecting arm having a vertical slot extending upwardly from said bottom surface and having a lower portion slidably receiving said upper portion of said vertical portion of said male connecting member.

32. A molding apparatus in accordance with claim 31 and further comprising means for resiliently supporting said shaking means independently of said flask supporting means.

33. A molding apparatus in accordance with claim 32 wherein said means for supporting said shaking means includes a spring having one end connected to a supporting surface and having another end connected to and supporting said shaking means.

34. A molding apparatus comprising a rigid mold flask adapted to contain a mold pattern and sand, means fixedly assembled to said mold flask for shaking the assembly of said mold flask and said shaking means as a whole body, said shaking means, the sand, and said mold flask, when substantially filled with sand, having a combined center of gravity, said shaking means providing horizontal vibrational forces directed in a horizontal plane extending approximately through said combined center of gravity, and means for resiliently supporting said mold flask and said shaking means for horizontal movement only.

35. A molding apparatus as set forth in claim 34 wherein said vibrational forces are one-dimensional and have a resultant force directed approximately through said combined center of gravity.

36. A molding apparatus as set forth in claim 34 wherein said shaking means includes means for selectively raising and lowering said horizontal plane of said vibrational forces.

37. A molding apparatus as set forth in claim 34 wherein said shaking means includes a pair of vibrators having counter-rotating members each rotating about a generally vertical axis.

38. A molding apparatus as set forth in claim 34 wherein said mold flask has a bottom end, and wherein said supporting means includes a support member extending downwardly from said bottom end for supporting said mold flask.

39. A molding apparatus as set forth in claim 34 wherein said supporting means includes a plurality of air bags beneath said mold flask, and a plurality of air bags beneath said shaking means.

40. A molding apparatus as set forth in claim 34 wherein said shaking means, the sand, and said mold flask, when partially filled with sand, have a second combined center of gravity lower than said first mentioned center of gravity, and wherein said horizontal plane of said vibrational forces extends between said first and second combined centers of gravity.

41. A molding apparatus as set forth in claim 40 wherein said vibrational forces are one-dimensional and have a resultant force directed approximately through a vertical line extending between said first and second combined centers of gravity.

42. A molding apparatus as set forth in claim 34 wherein said molding apparatus further comprises interengageable means on said mold flask and on said shaking means for removably securing said shaking means to said mold flask.

43. A molding apparatus as set forth in claim 42 wherein said mold flask includes a vertical wall, and wherein said interengageable means includes first and second horizontally spaced apart connecting members fixedly attached to said wall in a horizontal plane below said horizontal plane of said vibrational forces, a third connecting member fixedly attached to said wall in a horizontal plane above said horizontal plane of said vibrational forces, and means connected to said shaking means for engaging said first, second, and third connecting members.

44. A molding apparatus as set forth in claim 42 wherein said mold flask includes a vertical wall, and wherein said interengageable means includes a connecting member fixedly attached to said vertical wall, and means connected to said shaking means for engaging said connecting member.

45. A molding apparatus as set forth in claim 44 wherein said means for engaging said connecting member includes a generally horizontal arm including clamping means for engaging said connecting member.

46. A molding apparatus as set forth in claim 45 wherein said connecting member has a portion including a generally vertical inner surface spaced apart from said vertical wall, and a generally vertical outer surface opposite said inner surface, and wherein said clamping means includes a rigid member fixedly attached to said arm and adapted to engage said inner surface of said connecting member, and a movable member connected to said arm and adapted to engage said outer surface of said connecting member.

47. A molding apparatus as set forth in claim 46 wherein said clamping means further includes a movable toggle linkage connected between said arm and said movable member of said clamping means such that movement of said toggle linkage causes movement of said movable member, and extendible and contractable hydraulic means connected between said arm and said toggle linkage for moving said toggle linkage so as to move said movable member into and out of engagement with said outer surface of said connecting member.

48. A molding apparatus as set forth in claim 46 and further comprising means for conveying said mold flask to and from said shaking means.

49. A molding apparatus as set forth in claim 48 wherein said conveying means conveys said mold flask generally horizontally to said shaking means such that said rigid member of said clamping means moves into a position between said vertical wall of said mold flask and said vertical inner surface of said connecting member, such that said rigid member of said clamping means is in position to engage said inner surface of said connecting member and said movable member of said clamping means is in position to engage said outer surface of said connecting member.

50. A molding apparatus comprising a rigid mold flask adapted to contain a mold pattern and sand, means fixedly assembled to said mold flask for shaking the assembly of said mold flask and said shaking means as a whole body, said shaking means, the sand, and said mold flask, when substantially filled with sand, having a first combined center of gravity, said shaking means, the sand, and said mold flask, when partially filled with sand, having a second combined center of gravity lower than said first combined center of gravity, and said shaking means providing horizontal vibrational forces directed in a horizontal plane extending between said first and second combined centers of gravity, and means for resiliently supporting said mold flask and said shaking means for horizontal movement only.

51. A molding apparatus as set forth in claim 50 wherein said vibrational forces are one-dimensional and have a resultant force directed approximately through a vertical line extending between said first and second combined centers of gravity.

52. A molding apparatus as set forth in claim 51 wherein said shaking means includes means for selectively raising and lowering the plane of said horizontal vibrational forces.

53. A molding apparatus as set forth in claim 52 wherein said shaking means includes a pair of vibrators having counter-rotating members each rotating about a generally vertical axis.

54. A molding apparatus as set forth in claim 50 wherein said supporting means includes a plurality of air bags beneath said mold flask, and a plurality of air bags beneath said shaking means.

55. A molding apparatus as set forth in claim 54 wherein said molding apparatus further comprises interengageable means on said mold flask and on said shaking means for removably securing said shaking means to said mold flask.

56. A molding apparatus as set forth in claim 55 wherein said mold flask includes a vertical wall, and wherein said interengageable means includes a connecting member fixedly attached to said vertical wall, and means connected to said shaking means for engaging said connecting member.

57. A molding apparatus as set forth in claim 56 wherein said means for engaging said connecting member includes a generally horizontal arm including clamping means for engaging said connecting member.

58. A molding apparatus as set forth in claim 57 wherein said connecting member has a portion including a generally vertical inner surface spaced apart from said vertical wall and a generally vertical outer surface opposite said inner surface, and wherein said clamping means includes a rigid member fixedly attached to said arm and adapted to engage said inner surface of said connecting member, and a movable member connected to said arm and adapted to engage said outer surface of said connecting member.

59. A molding apparatus as set forth in claim 58 wherein said clamping means further includes a movable toggle linkage connected between said arm and said movable member of said clamping means such that movement of said toggle linkage causes movement of said movable member, and extendible and contractable hydraulic means connected between said arm and said toggle linkage for moving said toggle linkage so as to move said movable member into and out of engagement with said outer surface of said connecting member.

60. A molding apparatus as set forth in claim 59 and further comprising means for conveying said mold flask to and from said shaking means.

61. A molding apparatus as set forth in claim 60 wherein said conveying means conveys said mold flask generally horizontally to said shaking means such that said rigid member of said clamping means moves into a position between said vertical wall of said mold flask and said vertical inner surface of said connecting member, such that said rigid member of said clamping means is in position to engage said inner surface of said connecting member and said movable member of said clamping means is in position to engage said outer surface of said connecting member.

62. A molding apparatus comprising a rigid mold flask adapted to contain a mold pattern and sand, said mold flask including a vertical wall, and a connecting member fixedly attached to said vertical wall, means fixedly assembled to said mold flask for shaking the assembly of said mold flask and said shaking means as a whole body, said shaking means including a housing having mounted therein a pair of vibrators rotating about generally vertical axes, and a generally horizontal arm having one end connected to said housing and an opposite end including clamping means for engaging said connecting member, said shaking means, the sand, and said mold flask, when substantially filled with sand, having a combined center of gravity, said shaking means providing horizontal vibrational forces directed in a horizontal plane extending approximately through said combined center of gravity, and means for resiliently supporting said mold flask and said shaking means for horizontal movement only.

63. A molding apparatus as set forth in claim 62 wherein said connecting member has a portion including a generally vertical inner surface spaced apart from said vertical wall, and a generally vertical outer surface opposite said inner surface, and wherein said clamping means includes a rigid member fixedly attached to said arm and adapted to engage said inner surface of said connecting member, and a movable member connected to said arm and adapted to engage said outer surface of said connecting member.

64. A molding apparatus as set forth in claim 63 wherein said clamping means further includes a movable toggle linkage connected between said arm and said movable member of said clamping means such that movement of said toggle linkage causes movement of said movable member, and extendible and contractable hydraulic means connected between said arm and said toggle linkage for moving said toggle linkage so as to move said movable member into and out of engagement with said outer surface of said connecting member.

* * * * *